US006907758B2

(12) United States Patent
Traenkle et al.

(10) Patent No.: US 6,907,758 B2
(45) Date of Patent: Jun. 21, 2005

(54) CIRCULAR KNITTING MACHINE HAVING AT LEAST ONE MOVEABLE THREAD GUIDE

(75) Inventors: Dietmar Traenkle, Balingen (DE); Harald Rehmann, Dotternhausen (DE)

(73) Assignee: Sipra Patententwicklungs - und Beteiligungsgesellschaft mbH, Albstadt (DE)

( * ) Notice: Subject to any disclaimer, the term of this patent is extended or adjusted under 35 U.S.C. 154(b) by 89 days.

(21) Appl. No.: 10/655,469

(22) Filed: Sep. 4, 2003

(65) Prior Publication Data

US 2004/0089027 A1 May 13, 2004

(30) Foreign Application Priority Data

Sep. 6, 2002 (DE) ..... 102 41 248

(51) Int. Cl.[7] ..... D04B 15/58
(52) U.S. Cl. ..... 66/141; 66/125 R
(58) Field of Search ..... 66/8, 19, 28, 141, 66/131, 126 A, 125 R

(56) References Cited

U.S. PATENT DOCUMENTS 1,116,190 A * 11/1914 Williams ..... 66/111
3,422,638 A 1/1969 Widdowson et al.
3,563,059 A 2/1971 Martinetz
3,672,186 A * 6/1972 Rab ..... 66/25
5,127,241 A * 7/1992 Plath ..... 66/141
5,826,446 A * 10/1998 Plath et al. ..... 66/140 R

FOREIGN PATENT DOCUMENTS

| | | |
|---|---|---|
| DE | 1 9444 454 | 4/1971 |
| DE | 29 34 694 A1 | 3/1981 |
| DE | 39 20 408 A1 | 1/1991 |
| DE | 195 11 949 A1 | 10/1996 |
| DE | 197 43 814 A1 | 4/1999 |
| GB | 1 256 196 | 12/1970 |

* cited by examiner

*Primary Examiner*—Danny Worrell
(74) *Attorney, Agent, or Firm*—Michael J. Striker

(57) ABSTRACT

A circular knitting machine is described which has a needle cylinder (1), at least one cylinder cam segment (6), a dial arrangement (9) having a dial (10) and at least one dial cam segment (11), an axis of rotation (7), which is coaxial with the needle cylinder (1) and the dial arrangement (10), and at least one thread guide element (25) intended to guide a thread (20). The cylinder cam segment (6) together with the thread guide element (25), and the dial cam segment (11) are rotatable about the rotational axis (7) relative to one another. The needle cylinder (1), and the dial arrangement (9) together with the thread guide (25) are moreover disposed displaceable relative to one another and parallel to the rotational axis (7). According to the invention, the thread guide element (25) is mounted moveable on the cylinder cam segment (6) (FIG. 2).

18 Claims, 8 Drawing Sheets

CIRCULAR KNITTING MACHINE HAVING AT LEAST ONE MOVEABLE THREAD GUIDE

FIELD OF THE INVENTION

The invention relates generally to a circular knitting machine comprising a needle cylinder, at least one cylinder cam segment, a dial arrangement having a dial and at least one dial cam segment, an axis of rotation, which is coaxial with the needle cylinder and the dial arrangement, and at least one thread guide element intended to supply a thread, wherein the cylinder cam segment together with the thread guide element, and the dial cam segment can be rotated about the rotational axis relative to one another, and wherein the needle cylinder and the dial arrangement together with the thread guide element are disposed displaceable relative to one another and parallel to the rotational axis.

BACKGROUND OF THE INVENTION

In a known circular knitting machine of this type (DE 19 44 454 A1) the cylinder and dial cams, or respectively the segments which form same, are disposed around an axis of rotation so as to be rotatable relative to one another. This serves the purpose of optionally adjusting the dial cam to synchronous draft or timing and afterdraft or delayed timing, respectively, in order thus to withdraw the dial needles simultaneously with the cylinder needles or—when viewed with respect to the circumferential direction of the needle cylinder—somewhat later than the latter into their completely drawn-back position (couliering position). Moreover the entire dial arrangement is mounted displaceable parallel to the axis of rotation, so that the height of the dial arrangement above the needle cylinder alters and thus the stitch length of the knitted goods to be produced on the circular knitting machine can be adjusted.

A problem with circular knitting machines of this type, which has so far not been satisfactorily solved, consists in the mounting of their thread guide elements, which serve to supply threads to the individual knitting points or systems. If a height adjustment of the dial arrangement takes place, then the height of the thread guide elements or respectively of the entire thread guides should be correspondingly altered so that the eyes or the like on them substantially maintain their relative position relative to the dial needles. If on the other hand the dial cam is rotated relative to the needle cylinder cam, in order for example to move from synchronous timing to delayed timing, then the thread guides should not be also rotated but should substantially maintain their relative position relative to the cylinder cam. This applies irrespective of whether the circular knitting machines have rotatable needle cylinders and dials and stationary cylinder and dial cams, or stationary needle cylinders and dials and rotatable cylinder and dial cams.

In the known circular knitting machine of the type described initially, the thread guides and all their parts are secured for this purpose o a common holding ring which is secured with the aid of carrier rods disposed parallel to the axis of rotation on a carrier which is disposed above the dial arrangement. This carrier can be moved up and down together with the dial arrangement but, during rotary movements of the dial cam relative to the cylinder cam, maintains its position relative to the cylinder cam segments. Thus the desired positions of the thread guides are automatically secured. What is disadvantageous, however, is that a thread guide ring surrounding the dial cam is required, the carrier rods required for the suspension of said ring make the arrangement of further structural components, such as yarn stripers for example, largely impossible and both the thread guide ring and the carrier rods hinder free access to the dial cam. Up to now these disadvantages have had to be accepted since other known types of fastening for the thread guides (e.g. DE 29 34 694 A1, DE 39 20 408 A1) are either unusable in circular knitting machines of the type described initially or result in other serious disadvantages. These consist especially in the fact that the thread guides have to be adjusted individually and set again manually after a height adjustment of the dial arrangement and/or a relative rotation of the dial cam in relation to the cylinder cam, and this is complicated and time-consuming. Moreover, with these types of fastenings for the thread guides, no automatic adjustments of the dial cam and/or of the entire dial arrangement can be carried out with the aid of stepping motors or the like, and therefore no complex circular knitting machines can be realised in which these adjustments can be carried out when knitting is in progress.

OBJECTS OF THE INVENTION

In contrast to the above it is an object underlying this invention to so design the circular knitting machine of the type described above that, despite of the described adjustment possibilities, free access to the cams is possible.

A further object of this invention is to so design the knitting machine defined above that sufficient space for additional structural components such as yarn stripers or the like is provided even in case the described adjustments are possible.

Yet another object of the present invention is a design of the circular knitting machine described above in such a manner that, also in case that the described adjustment possibilities are given, no additional carrier ring is required for the thread guides.

SUMMARY OF THE INVENTION

These and other objects are solved in accordance with the present invention by movably mounting the thread guide element on the cylinder cam segment.

Because the thread guide elements are mounted displaceable on cylinder cam segments which are associated with them, the space above the dial cam can remain largely free. If the thread guide elements are pivotably attached to the cylinder cam segments in such a manner that they can be pivoted radially outwards into an out-of-action position, the access to the machine during repair and maintenance work is improved still further.

Further advantageous features of the invention arise from the dependent claims.

BRIEF DESCRIPTION OF THE DRAWINGS

The invention is described in greater detail below with the aid of an embodiment and in conjunction with the accompanying drawings. These show.

DETAILED DESCRIPTION OF THE DRAWINGS

Figure 1:
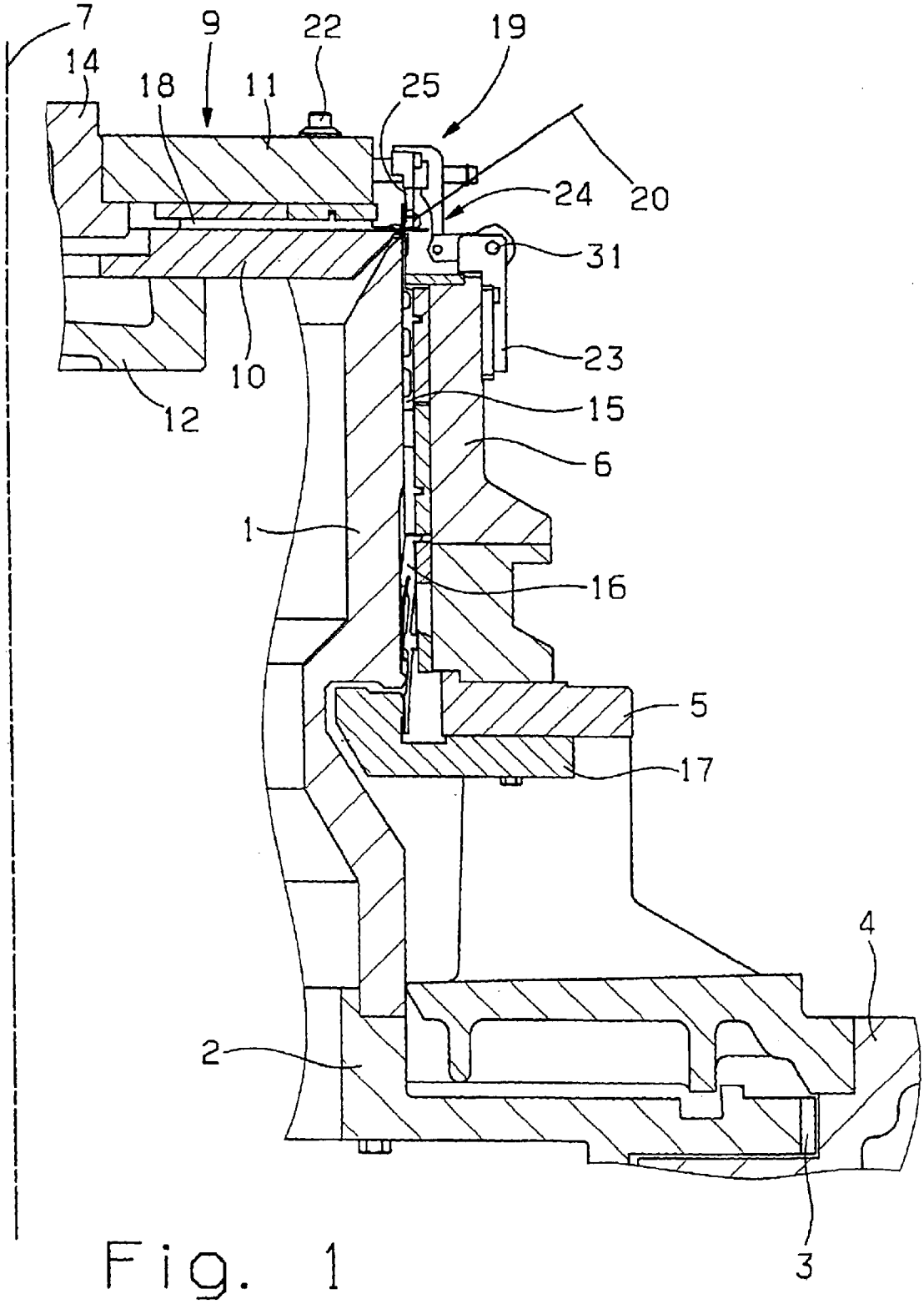
FIG. 1 diagrammatically a vertical radial section through a circular knitting machine according to the invention.

According to FIG. 1, a circular knitting machine contains a, preferably rotatably mounted, needle cylinder 1 which is mounted on a carrier ring 2 having external toothing 3. The external toothing 3 engages in known manner with a driving toothed wheel which can be driven by gear parts, which are not shown, by means of a drive motor which is also not shown. The carrier ring 2 is rotatably mounted in a stationary annular base plate 4 which bears a carrier ring 5 which is also stationary and on which a cylinder cam is secured which is composed of a plurality of cylinder cam segments 6, which are disposed distributed in the circumferential direction of the needle cylinder 1 and around a rotational axis 7 which is coaxial with said cylinder. One segment 6 of this type is present, for example, per knitting system of the circular knitting machine.

Above the needle cylinder 1 is provided a dial arrangement 9, which contains a dial 10 and a dial cam which, like the cylinder cam, is composed of a plurality of dial cam segments 11, which are disposed distributed in the circumferential direction of the needle cylinder 1. The dial 10 is mounted on a dial carrier 12 which is mounted rotatable in a machine frame which is not shown in detail, whereas the dial cam segments 11 are secured in a stationary manner to a dial cam carrier 14 which is securely connected to the machine frame. It is clear that on the circumference of the circular knitting machine can be arranged at least one cylinder cam segment 6 and one dial cam segment 11, preferably however a plurality of cylinder cam segments 6 and dial cam segments 11. The needle cylinder 1 is fitted in known manner with cylinder needles 15 and associated control elements 16, a selection of the cylinder needles 15 according to the pattern being possible with the aid of selection devices 17 such as electromagnets for example. Correspondingly, the dial 10 is fitted with dial needles 18, which can be preferably also selected according to the pattern using means which are not shown. As for the rest, the cylinder and rib needles 15, 18 are provided in known manner with feet which are guided on preselected paths by cam portions which are secured to segments 6, 11.

Furthermore the circular knitting machine is provided with first means which are not shown and by means of which the position of the entire dial arrangement 9 can be adjusted parallel to the axis of rotation 7 and relative to the needle cylinder 1, in order to alter the axial spacing of the cylinder and dial needles 15, 18 and thus the size of the stitches of the knitted goods to be produced. Moreover, second means are present which are not shown and by means of which the dial cam segment 11 (or respectively all the dial cam segments 11 present simultaneously) and the cylinder cam segment 6 can be rotated about the axis of rotation 7 relative to one another in order to adjust the dial cam to synchronous draft or afterdraft in dependence on the desired type of knitting.

Moreover, the circular knitting machine has on each knitting system at least one associated thread guide 9, by means of which respectively at least one thread 20 coming from a supply bobbin can be supplied to the cylinder and dial needles 15, 18.

Finally, the circular knitting machine can be additionally provided with adjusting members 21 (e.g. FIG. 4) and 22 (e.g. FIGS. 1 and 4) which make possible individual adjustment of the take-down depth of the cylinder or dial needles 15, 18 on each knitting system. Circular knitting machines of the described type are commonly known and therefore do not need to be explained in greater detail to the person skilled in the art. Reference is made by way of example in this context to the publications DE 19 44 454 A1 and DE 197 43 814 A1, which are hereby incorporated by reference as subject matter of the present disclosure, in order to simplify the illustration.

According to an embodiment of the invention, deemed to be the best one up to now, the thread guides 19 are mounted so as to be moveable, i.e. displaceable and preferably pivotable on cylinder cam segments 6 which are associated with them, as is explained in greater detail below with the aid of FIGS. 2 to 4 in connection with one of the cylinder cam segments 6. The other thread guides 19 present are expediently correspondingly formed and mounted.

Figure 2:
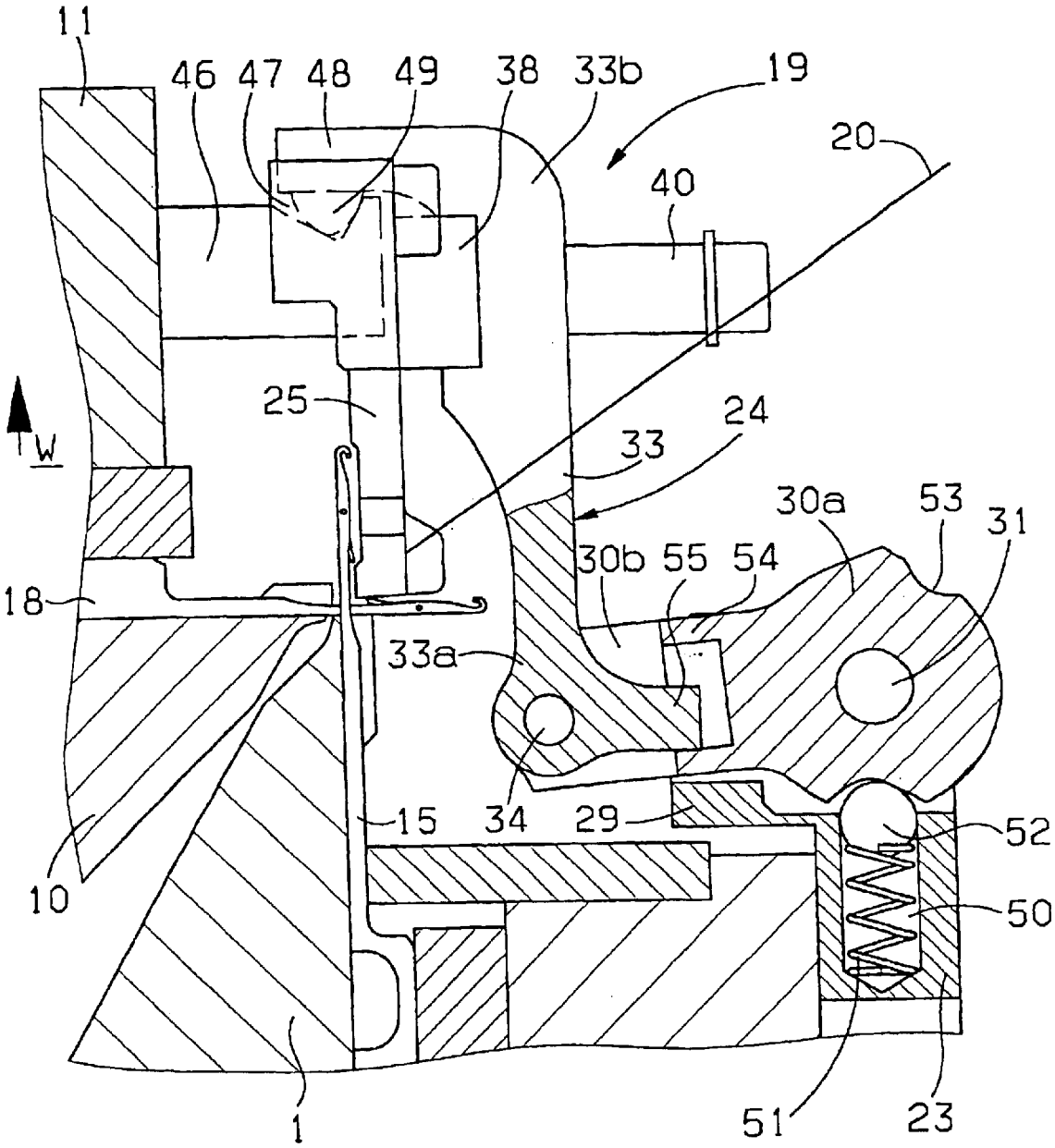
FIGS. 2 and 3 each an enlarged detail of FIG. 1, with two different height settings of a dial arrangement and a thread guide.
Figure 3:
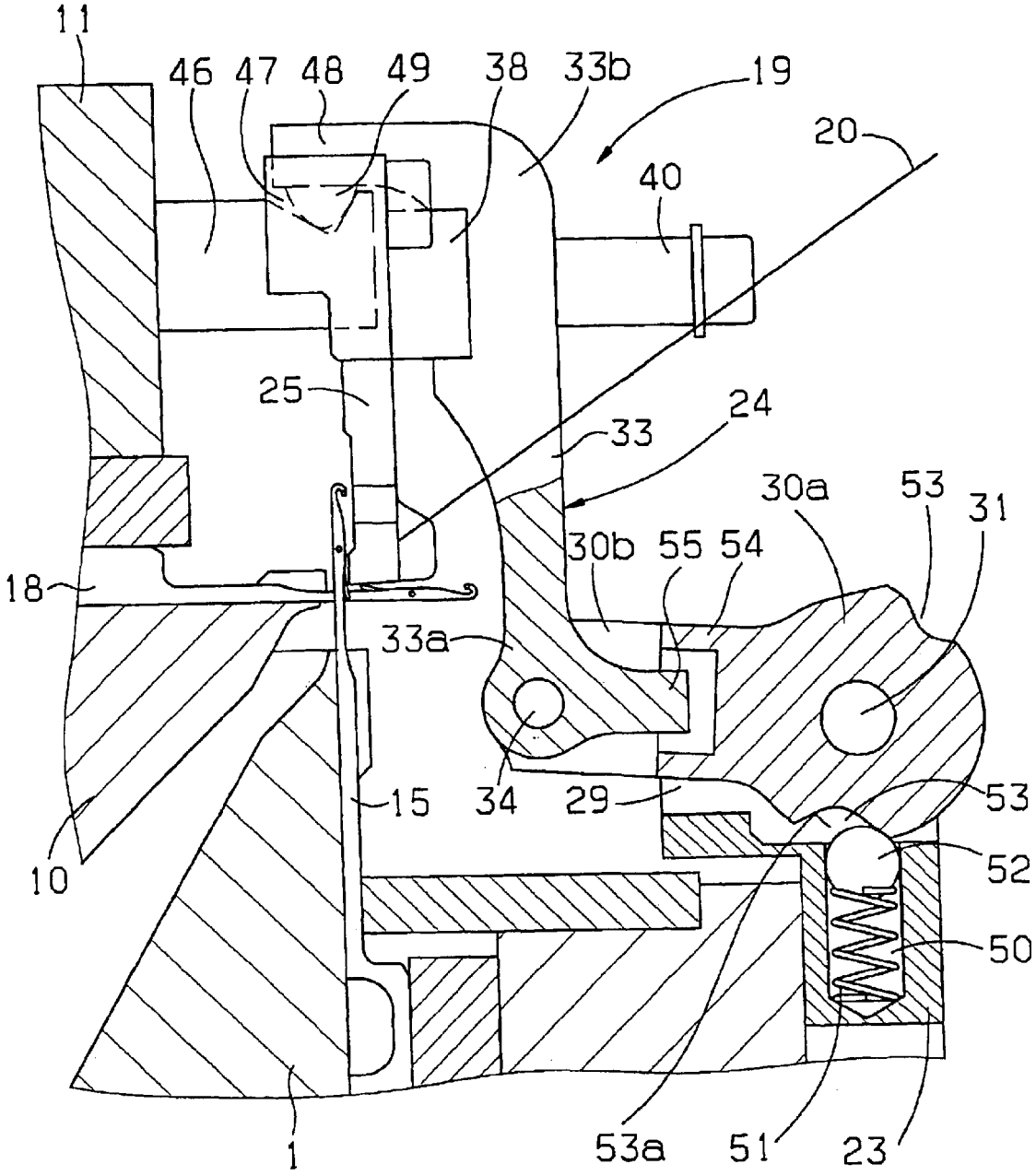
Figure 4:
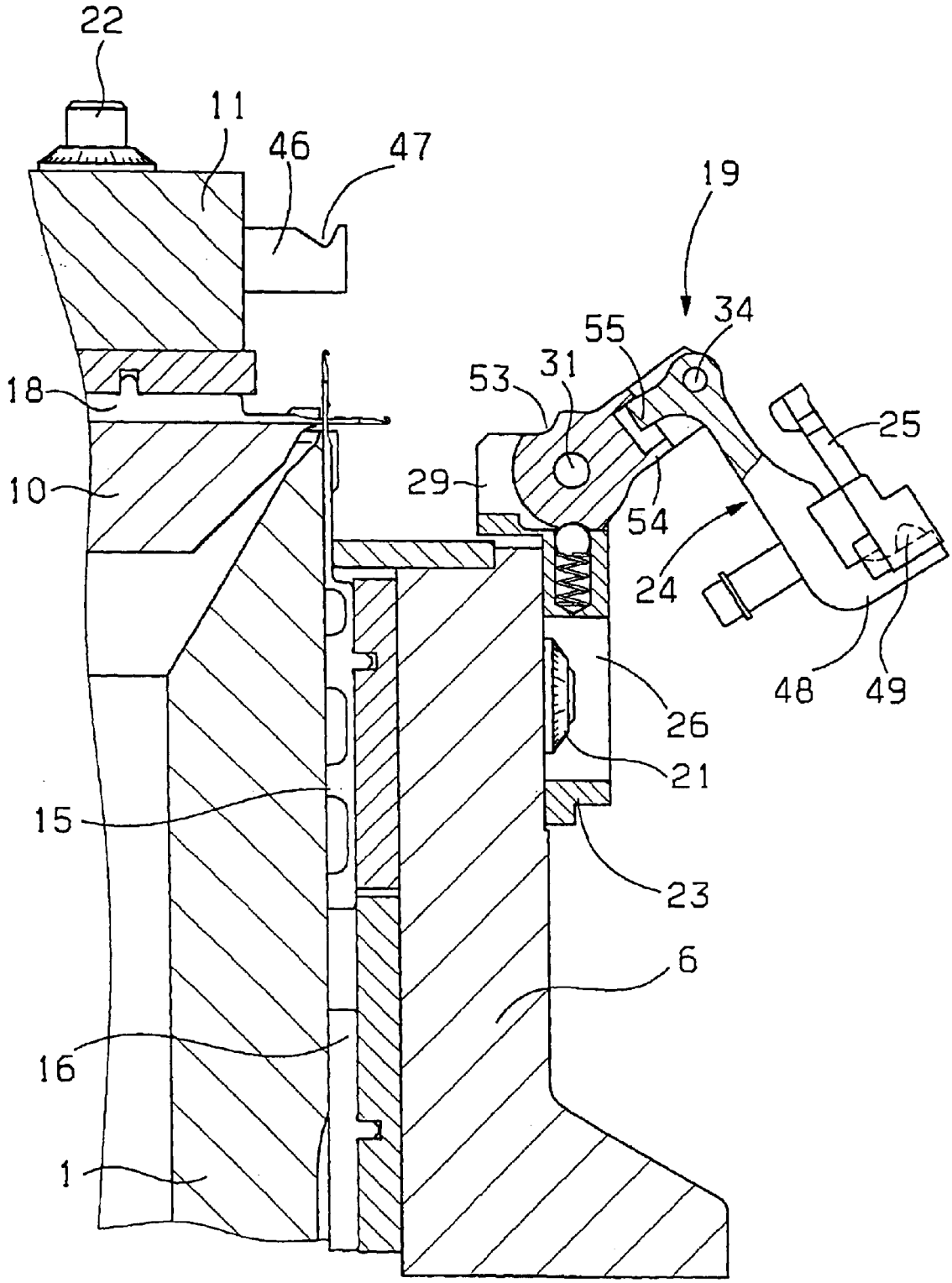
FIG. 4 a detail corresponding to FIGS. 2 and 3 but not quite so greatly enlarged, the thread guide having been pivoted into an out-of-action position.

In the embodiment according to FIGS. 2 to 4, the thread guide 19 is mounted with the aid of a holder 23 so as to be pivotable on the cylinder cam segment 6. The thread guide 19 contains a lever mechanism 24 and a thread guide element 25. The holder 23 is securely fastened to an upper end and to a side of the cylinder cam segment 6 lying radially on the outside. In a central portion, the holder 23 has a through hole 26 (FIGS. 4, 5, and 7) through which the adjusting member 21 is accessible. As especially FIGS. 5 to 8 show, the holder 23 is provided in an edge portion surrounding the hole 26 with bores 27 for fastening screws 28, by means of which it can be secured to the associated segment 6. In an upper portion, the holder 23 is configured fork-like and provided with two parallel fork members 29, which form a U-shaped receiver for a disc-shaped end portion 30*a* of a first lever 30 of the lever mechanism 24. A pivot 31, which protrudes through coaxial bores in the end portion 30*a* and in the two fork members 29, serves the pivotable mounting of the lever 30 in the holder 23. An imaginary longitudinal axis of the holder 23 here is substantially perpendicular to an imaginary longitudinal axis of the first lever 30, whilst a pivot axis 32 (FIG. 5) of the pivot 31 is substantially perpendicular to these two axes. In the mounted state of the thread guide 19, therefore, the pivot axis 32 of the pivot 31, as is apparent e.g. from FIGS. 1 and 9, is on the one hand perpendicular to the axis 7 of rotation, and on the other hand substantially perpendicular to an imaginary radius of the needle cylinder 1 or the dial 10, said radius proceeding from the rotational axis 7 and being extended through the centre point of the pivot 31.

Figure 7:
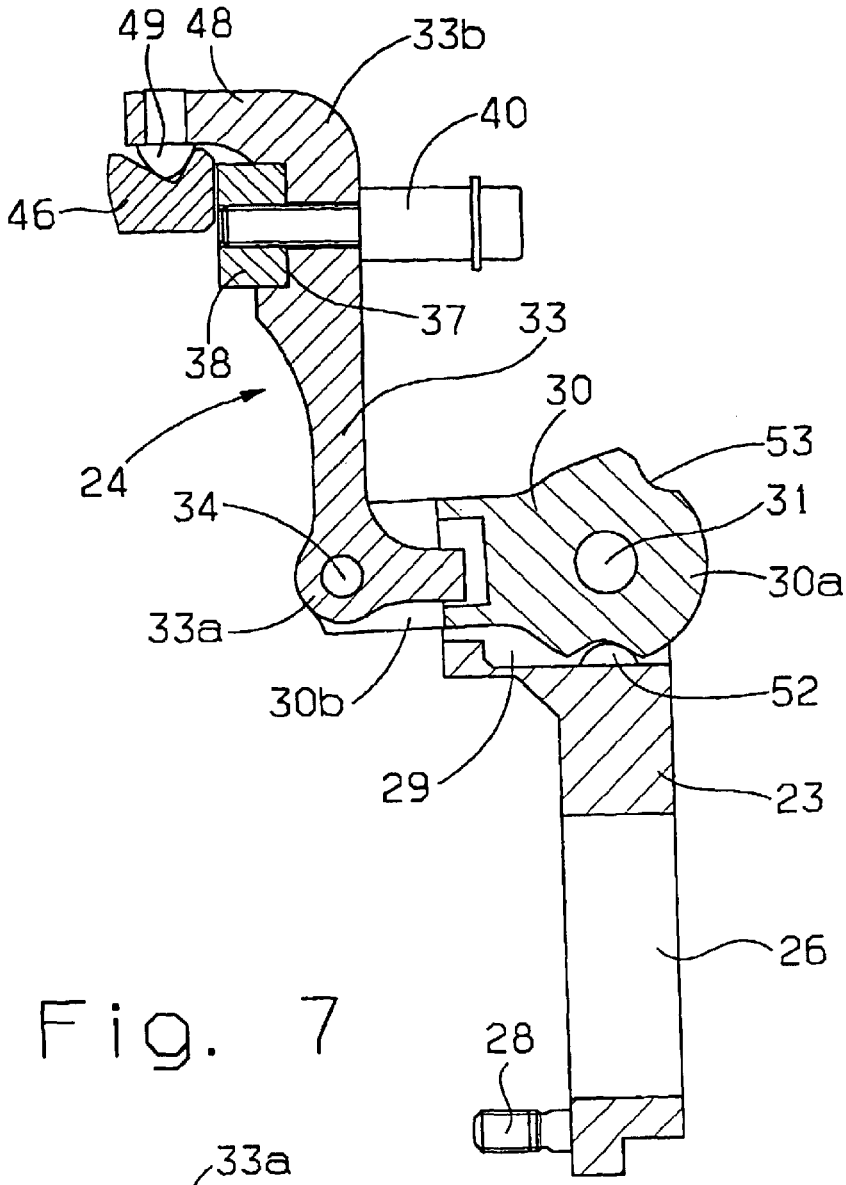
Figure 8:
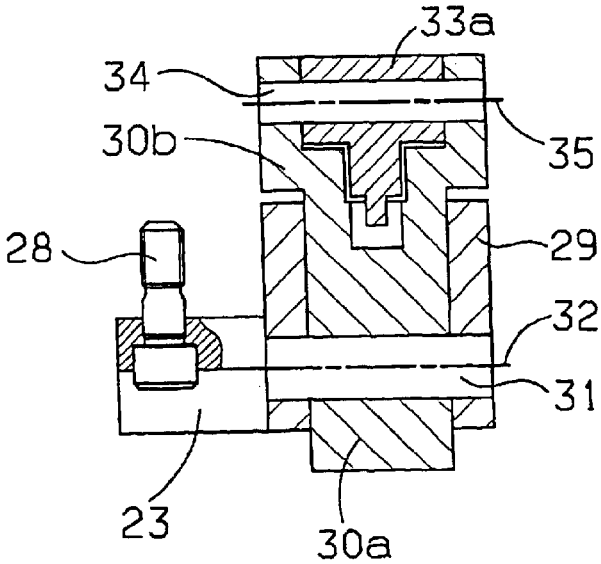

According to FIGS. 7 and 8, the lever arm 30 is configured fork-like at an end portion remote from end portion 30*a* and provided with two parallel fork members 30*b* which form a U-shaped receiver for the one end portion 33*a* of a second lever 33 of the lever mechanism 24. A pivot 34 which protrudes through coaxial bores in this end portion 33*a* and in the fork members 30*b*, serves the pivotable connection of the two levers 30 and 33, a pivoting axis 35 of pivot 34 being disposed parallel to the pivoting axis 32 of the pivot 31. The articulation of the lever 30 with the holder 23, effected by the pivot 31, serves moreover the pivotable mounting of the entire lever mechanism 24 on the holder 23, an imaginary longitudinal axis of the second lever 33 being disposed substantially perpendicular to the longitudinal axis of the first lever 30 and parallel to the longitudinal axis of the holder 23 in the mounted state and when the thread guide 19 is in the operating position. Moreover, the second lever 33 extends, according to FIG. 7, preferably above both the first lever 30 and the holder 23.

Figure 9:
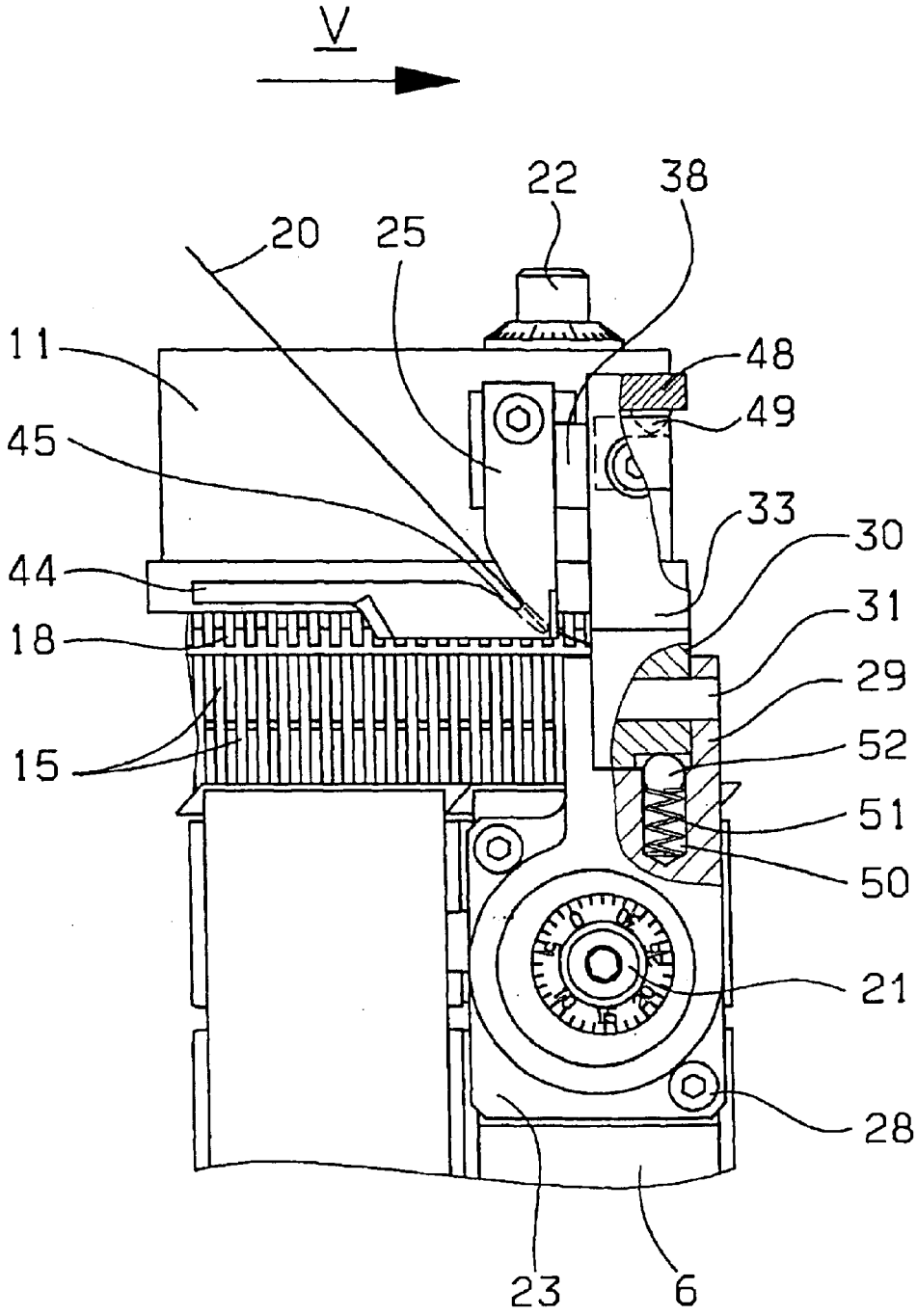
FIGS. 9 and 10 each a diagrammatic front elevation, partially in section, of the circular knitting machine on a scale corresponding roughly to FIGS. 2 and 3 and in two different relative rotational positions of a dial cam and a cylinder cam.

As e.g. FIGS. 1, 7 and 9 show, in the mounted state of the thread guide 19, the first lever extends substantially radially inwards and the second lever 33 is disposed substantially parallel to the rotational axis 7 of the circular knitting machine. Therefore the lever 30 could also be described as a radial connecting rod in which pivot 31 is disposed radially outside and pivot 34 radially inside. By contrast, the lever 33 can also be described as a vertical connecting rod in which the end portion 33*a* is disposed with pivot 34 axially beneath and a further end portion 33*b* axially above.

As FIGS. 5 to 8 also show, there is provided on the end portion 33*b* of the lever 33 a groove 37 in which one end of a slider or tangential holder 38 is mounted so as to be displaceable, specifically substantially in a direction parallel to the pivoting axes 32 and 35. Moreover end portion 33*b* has an elongated hole 39 (FIG. 5), the long side of which is disposed parallel to pivot 31, whilst the end of the slider 38 which is located in the groove 37 is provided with a threaded bore into which is inserted a fastening screw 40 which also protrudes through the elongated hole 39. Thus the slider 38 can be moved backwards and forwards within limits determined by the edges of the elongated hole 39 and be fixed in a predetermined position by means of the fastening screw 40.

Figure 5:
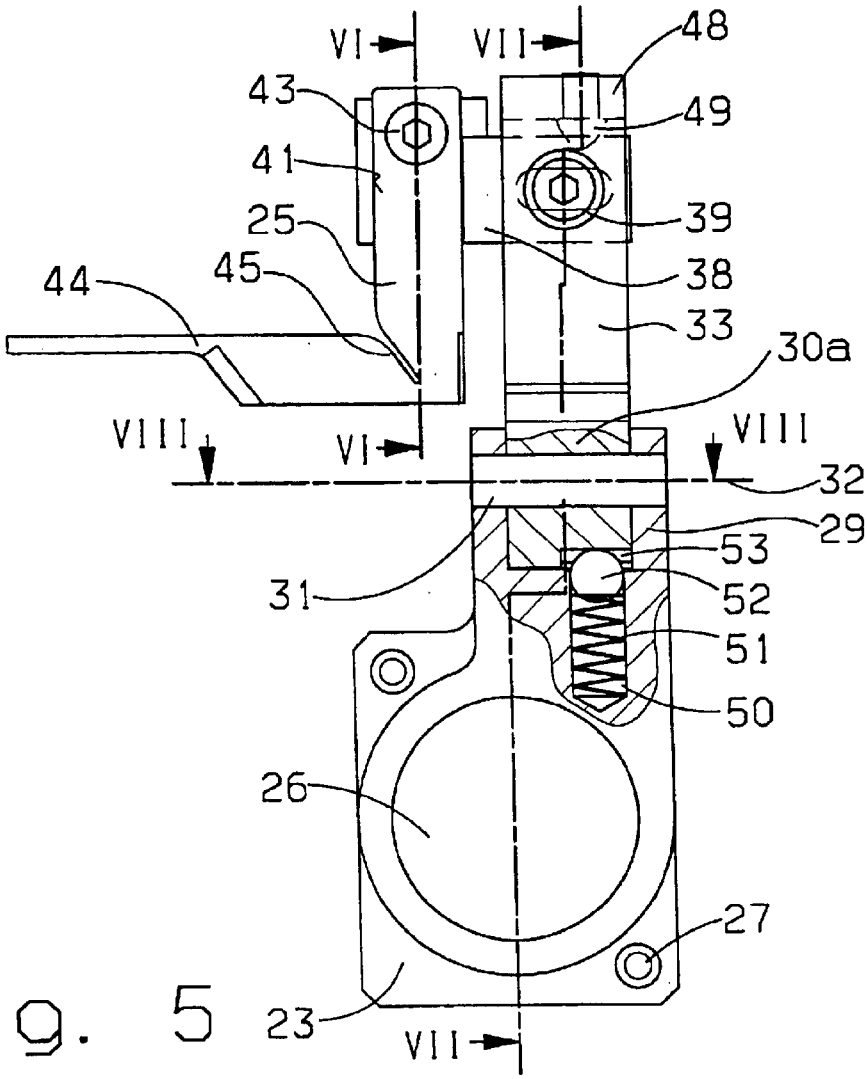
FIG. 5 a front elevation, partially in section, of a holder and a lever mechanism, which is pivotably mounted on said holder, for a thread guide element according to a preferred embodiment of the invention.
Figure 6:
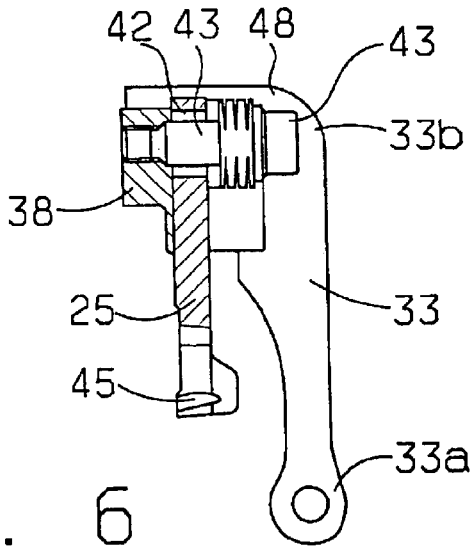
FIGS. 6 to 8 sections along lines VI—VI to VIII—VIII of FIG. 5.

At the other end of the slider 38 is secured an upper end of the thread guide element 25. For this purpose, the slider 38 has there a groove 41 (FIG. 5) and in its base a threaded bore, which is aligned with an elongated hole 42 (FIG. 6) in the upper end of the thread guide element 25 and accommodates a fastening screw 43 protruding through this elongated hole 42. Imaginary longitudinal axes of the groove 41 and of the elongated hole 42 are substantially parallel to the imaginary longitudinal axes of the second lever 33 and of the holder 23 and extended so far that the thread guide element 25 according to FIG. 5 is disposed laterally beside the second lever 33. With the aid of the fastening screw 43, the thread guide element 25 can be moved up and down parallel to its imaginary longitudinal axis within the limits predetermined by the elongated hole 42 and be fixed in a preselected position.

The thread guide element 25 per se can be configured in any way at all. However it is particularly advantageous for it to be angled by approximately 90° at its lower end (FIGS. 5, 6 and 9) along a narrow connecting web and thus be provided with a web 44 which is disposed substantially parallel to the pivoting axis 32 and which forms with the main part, disposed perpendicular thereto of the thread guide element 25 a narrow guide slot 45, into which the thread 20 can be inserted in order to offer it to the knitting needles 15, 18.

When the knitting needles 15 are used in the form of latch needles, web 44 is expediently configured as a latch opener or respectively a holding-open device for the latches of the needles 15, so that it is ensured that the latches of the knitting needles 15 brought near in the direction of an arrow v (FIG. 9) are opened before the thread guide 19 is reached, or are kept open. Such a design of the thread guide element 25 is expedient above all when the circular knitting machine on which it is mounted is equipped with automatic thread-changing devices (cf. e.g. DE 195 11 949 A1).

As for example FIGS. 2 and 7 show, there is associated with each thread guide 19 a guiding part 46 attached to the dial cam, said guiding part being preferably secured to the associated dial cam segment 11 and protruding radially from said segment towards the outside. The guiding part 46 is provided with a guiding groove 47 which is represented in FIGS. 2 and 3 in a broken line but in FIG. 4 by a continuous line, said groove being configured here as a V-shaped groove which is open upwards. The guiding part 46 serves to bear and support a supporting member 48 which is formed on a part, which protrudes radially inwards and over the slider 38, of the upper end portion 33*b* of the second lever 33. The supporting member 48 preferably contains a protruding sliding element 49 which can be inserted into the guiding groove 47 and which consists for example of a bolt having an end which tapers conically downwards, and being glued or pressed into a bore in the end portion 33 or supporting member 48 and protrudes from same parallel to the lever 33 downwards, i.e. in the direction of the other end portion 33*a*. The guiding groove 47 extends, as is clear for example from FIGS. 9 and 10, substantially perpendicular to the rotational axis 7 and perpendicular to the radial direction, i.e. substantially parallel to a tangent to the circle of needles of the needle cylinder 1. By particular preference, the guiding groove 47 extends here along a circular path segment coaxial with the rotational axis 7 (FIG. 11), the radius of which corresponds to the spacing of the guiding groove 47 from the rotational axis 7 (FIG. 1). In FIG. 11, the curvature of the guiding groove 47 is represented disproportionately large.

According to a preferred embodiment, which can be seen e.g. in FIGS. 2, 3 and 5, the holder 23 has in its upper region a blind hole 50 which is parallel to its longitudinal axis and which opens out into the receiver, formed by the fork members 29, for the end portion 30*a* of the lever 30. On the base of the blind hole 50 is supported a spring 51, here configured as a helical spring, which bears a locking ball 52 lying on its free end and tries to press said ball into the receiver for the end portion 30*a*. The end portion 30*a* is here configured as a flat disc which is designed cylindrical on most of its circumference and provided with at least two index notches or recesses 53, into which the locking ball 52 can enter when the end portion 30*a* is in the appropriate rotational position. The recesses 53 are preferably limited by guide surfaces 53*a* (FIG. 3) which are configured in such a way, e.g. disposed in a V-shape, that the spring 51 attempts, after the locking ball 52 has snapped into one of the recesses 53, to maintain, or respectively produce again after a deflection, a preferred rotational position of the end portion 30*a* in which the locking ball 52 assumes a centered position in the respective recess 53.

The functioning of the described thread guide 19 is substantially as follows:

After the thread guide 19 has been mounted on the cylinder cam segment 6 in the described manner which is clear from the drawings, the second lever 33 is disposed substantially parallel to the rotational axis 7. Now initially the thread guide element 25 can be so adjusted that the end of the guiding slot 45 guiding the thread 20 assumes an optimal position, relative to the knitting needles 15, 18, for the insertion of the thread 20. Here it is possible to proceed e.g. from the arrangement shown in FIG. 2, in which the axial spacing of the dial arrangement 9 from the upper end of the needle cylinder 1 is the smallest. The supporting member 48 is here in a position supported on the guiding part 46, in which position the sliding element 49 lies in the guiding groove 47. The guiding slot 45 can be adjusted relative to the knitting needles 15, 18 by the fastening screws 40, 43 being released, the slider 38 being displaced tangentially with respect to the circle of needles, and/or the thread guide element 24 being displaced substantially parallel to the rotational axis 7, and the fastening screws 40, 43 being screwed tight again after a preselected position has been produced. In addition, the radial position of the thread guide element 25 relative to the rotational axis 7 could also be adjustable, by a further adjustment possibility being provided or appropriate washers being placed between the slider 38 and the thread guide element 25. The circular knitting machine is now ready for operation.

If the height of the dial arrangement 9 above the needle cylinder 1 is to be altered, only the usual adjusting mechanism requires to be actuated for this purpose (e.g. DE 19 44 454 A1). The thread guide element 25 and the guide slot 45 automatically make the same, movement in the direction of an arrow w (FIG. 2), because the thread guide 19 is connected in an interlocking manner to the dial arrangement 9 on account of the guiding part 46 gripping under the supporting member 48 during upwardly directed axial movements of the dial arrangement 9. Through this axial motion, the lever mechanism 24 is pivoted e.g. from the position according to FIG. 2 into the position according to FIG. 3. By suitable choice of the lengths of the levers 30 and 33, of the arrangement of the thread guide element 25 on the thread guide 19 and of the position of the pivot 31 it can be achieved that the second lever 33 is only pivoted slightly in a radial direction and therefore the guide slot 45 substantially maintains its radial position relative to the cylinder needles 15 (cf. 2 and 3). This ensures that the thread 20 is securely inserted into the hooks of the cylinder needles 15 as they are withdrawn. Moreover, the guide slot 45, after an axial displacement of the dial arrangement 9 (FIG. 3), assumes practically the same axial position relative to the dial needles 18 as in FIG. 2, such that the thread 20 can also be perfectly supplied to the dial needles 18.

If the dial arrangement 9 is later lowered again for the purpose of reducing its spacing from the needle cylinder 1, the thread guide 19 also makes this movement in the opposite direction to arrow w in FIG. 2. This is firstly a result of gravity and secondly caused by the spring 51. Since the end portion 30*a* of the lever 30 is rotated clockwise about the pivot 31 during a movement of the dial arrangement 9 in the direction of arrow w, the locking ball 52 here runs according to FIG. 3 onto one of the guide surfaces 53*a* of the associated recess, with the result that the spring 51 is tensioned more strongly. As the dial arrangement 9 is lowered, the spring 51 then presses against the guide surface 53*a* and thus exercises a rotary moment in an anti-clockwise direction on the end portion 30*a*, such that the thread guide 19 is coupled to the guiding part 46 by a frictional connection during this movement and is moved with said guiding part. Naturally other types of coupling are also possible.

For the function of the web 44 or respectively of the latch opener formed on same, the movement of the dial arrangement 9 parallel to the arrow w is not critical. It is merely necessary to form the parts intended to open, or respectively keep open, the needle latches so high that they are effective in each provided axial position of the dial arrangement 9.

A substantial advantage of the described, and currently considered to be the best, embodiment consists in the fact that the thread guide 19 can be pivoted out of the operating positions according to FIGS. 2 and 3 radially outwards into an out-of-action position according to FIG. 4. For this purpose, it is merely necessary to raise the thread guide 19 slightly by hand in the direction of arrow w (FIG. 2) until the sliding element 49 has emerged from the guiding groove 47, and then to pivot it as a whole clockwise about the pivot 31. In a desired out-of-action position, the locking ball 52 can then lock into a further recess 53 formed on the circumference of the end portion 30*a* (FIG. 4). This possibility of pivoting the thread guide 19 backwards and forwards is independent of the height at which the dial arrangement 9 is located and of the relative rotational position which the dial cam segment 11 assumes relative to the cylinder cam segment 6.

Figure 10:
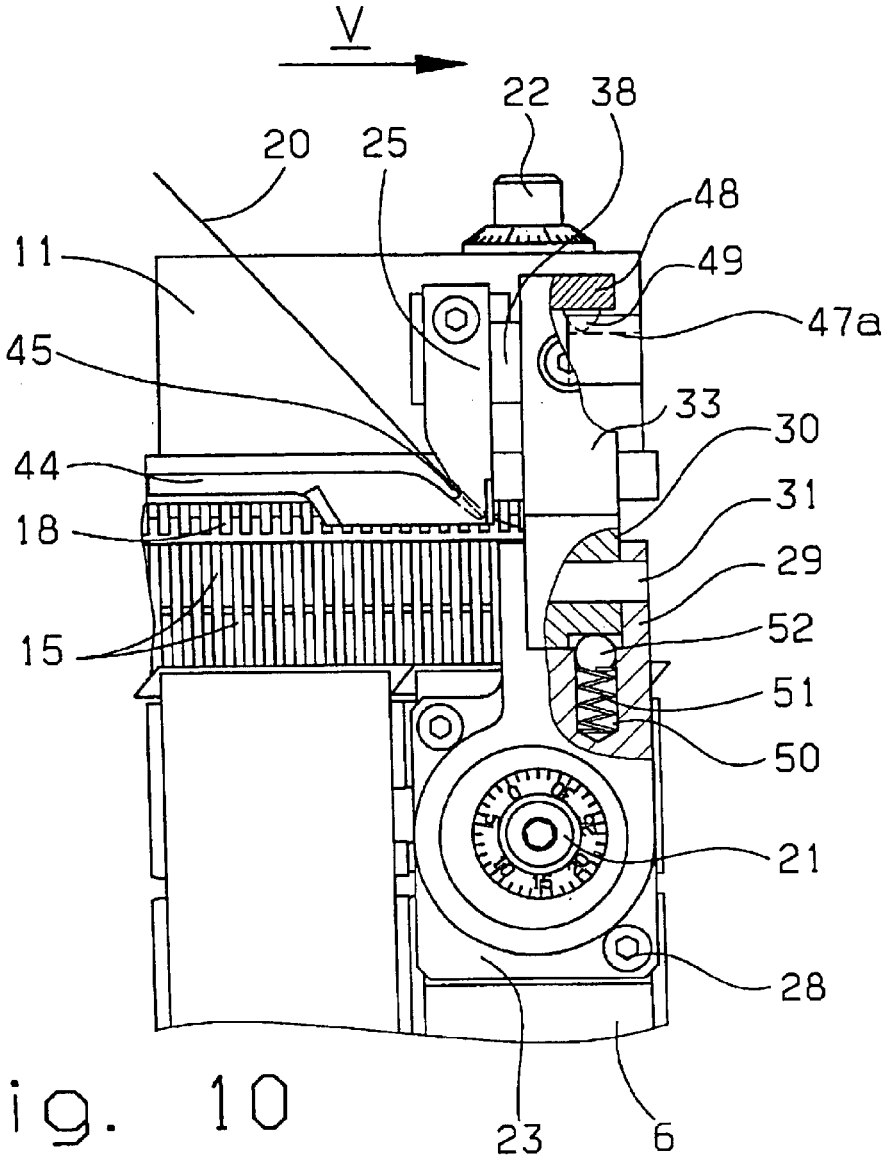
Figure 11:
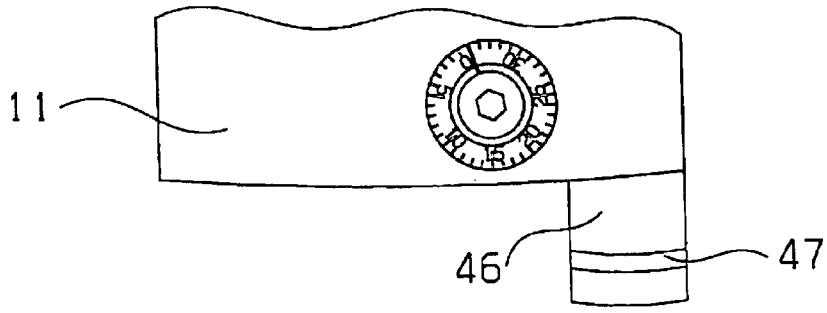
FIG. 11 a diagrammatic plan view of a guiding part formed on a dial cam segment according to FIGS. 9 and 10.

Furthermore it is possible, as particularly FIGS. 9 and 10 show, to rotate the dial cam segment 11 about the rotational axis 7 in the circumferential direction relative to the cylinder cam segment 6. For this purpose again means which are known per se can be used (e.g. DE 19 44 454 A1). FIG. 9 shows for example a position in which the needle cylinder 1 and the dial 10 operate with synchronised draft, i.e. in which the deepest points of the needle paths of the two cam segments 6, 11 lie vertically above one another. On the other hand, FIG. 10 shows an adjustment to afterdraft (delayed timing) in which the dial cam segment 11 is displaced, as compared with the position according to FIG. 9, by several needle spacings (gauges) in the direction of arrow v. The thread guide 19, however, remains unaltered in the position according to FIG. 9, because as the dial cam segment 11 is rotated, the guiding part 46 secured to same is also displaced in the direction of the arrow v and can slide along supporting member 48 (FIG. 7) or respectively sliding element 49 of the thread guide 19 which cannot be displaced in this direction v, as is indicated by a broken line 47*a* in FIG. 10.

The invention is not limited to the described embodiment which can be modified in many ways. This applies for example to the lever mechanism 24 in which the two levers 30 and 33 can also be securely connected to one another to form a one-piece part. In this case, appropriate choice of the lengths of the levers 30, 33 and of the position of the pivot 31 can again ensure that the position of the guide slot 45 (or any thread guide eye or the like) is only comparatively slightly altered when the dial arrangement 9 is displaced over the entire adjustment range provided for it in the direction of arrow w, and therefore does not have to be corrected. Furthermore, the thread guide 19 can also be coupled to the dial cam segment 11 by other means in the direction of the arrow w (or respectively in the opposite direction thereto). A reversal of the movements would also be conceivable, insofar as the cylinder cam segment 6 is rotated relative to the dial cam segment 11, or respectively the needle cylinder 1 is moved together with the cylinder cam segment 6 axially relative to the dial arrangement 9. Apart from this, the thread guide element 25 could be guided on the cylinder cam segment 6 so as to be axially displaceable instead of radially pivotable, in which case the pivot mechanism 24 would disappear and be replaced for example by a slip-in guide. In this variant also, the axial coupling could be effected by means of parts 46 to 49 and if necessary by means of additional springs or the like. Further, both variants can be provided, instead of with the engaging means 52 and 53, with other locking means being easily operable and serving to fix the thread guides 19 at least in the operating positions. Insofar, the phrases "pivotable", "displaceable" or, in general, "moveable" are to be understood in such a manner that the desired and described adjustments are possible without complicated manipulations and that at least after an unlocking of the locking means preferably also a central adjustment of the distance or the angular position between the cylinder 1 and the dial arrangement 9 can be carried out. Furthermore, in an advantageous manner stroke-limiting means can be provided which prevent unintentional pivoting of the thread guide 19 radially inwards or outwards.

This purpose is served by e.g. two end stops 54 (FIGS. 2 to 4) attached to lever 30, between which stops an extension 55 attached to lever 33 is disposed. Thus the two end stops 54 fix the maximum pivoting range of the lever 33 when the end portion 30*a* of the first lever is in the locking position, which is also expedient in producing the out-of-action position according to FIG. 4. Finally it goes without saying that the various features can also be applied in combinations other than those illustrated and described.

It will be understood, that each of the elements described above or two or more together, may also find a useful application in other types of constructions differing from the types described above.

While the invention has been illustrated and described as embodied in a knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics or the generic of specific aspects of this invention.

What is claimed as new desired to be protected by Letters Patent is set forth in the appended claims.

What is claimed is:

1. Circular knitting machine, comprising: a needle cylinder (1), at least one cylinder cam segment (6), a dial arrangement (9) having a dial (10) and at least one dial cam segment (11), an axis of rotation (7), which is coaxial with the needle cylinder (1) and the dial arrangement (9), and at least one thread guide element (25) intended to supply a thread (20), wherein said thread guide element (25) is mounted moveable on the cylinder cam segment (6), wherein said cylinder cam segment (6) together with said thread guide element (25), and said dial cam segment (11) can be rotated about said rotational axis (7) relative to one another, and wherein said needle cylinder (1), and said dial arrangement (9) together with said thread guide element (25) are disposed displaceable relative to one another and parallel to said rotational axis (7).

2. Circular knitting machine according to claim 1, wherein said dial cam segment (11) has a guiding part (46) and said thread guide element (25) has a supporting member (48) which is supported on said guiding part and is displaceable in a circumferential direction of said needle cylinder (1) relative to same.

3. Circular knitting machine according to claim 2, wherein said guiding part (46) contains a guiding groove (47) and said supporting member (48) contains a sliding element (49) disposed in said groove.

4. Circular knitting machine according to claim 3, wherein said guiding groove (47) is configured V-shaped and said sliding element (49) is configured conical.

5. Circular knitting machine according to one of claims 2, 3 or 4, wherein said supporting member (48) is coupled to said guiding part (46) by a force of a spring (51).

6. Circular knitting machine according claim 1, wherein said thread guide element (25) is pivotably mounted on said cylinder cam segment (6).

7. Circular knitting machine according to claim 6, wherein said thread guide element (25) and a lever mechanism (25) connected thereto are constituent parts of a thread guide (19), which is pivotably mounted on a holder (23) secured to said cylinder cam segment (6).

8. Circular knitting machine according to claim 7, wherein said lever mechanism (24) has a first lever (30) which is connected to said holder (23) in an articulated manner and a second lever (33) connected to said thread guide element (25).

9. Circular knitting machine according to claim 8, wherein said first and said second levers (30, 33) are rigidly connected to one another.

10. Circular knitting machine according to claim 8, wherein said first and said second levers (30, 33) are connected to one another in an articulated manner.

11. Circular knitting machine according to one of claims 6, 9 or 10, wherein said thread guide (19) can be pivoted from an operating position radially outwards into an out-of-action position.

12. Circular knitting machine according to claim 8, wherein said first lever (30) is pivotably mounted on said holder (23) by means of a disc-shaped end portion (30*a*), and wherein said holder (23) and said end portion (30*a*) are provided with locking means (52, 53) associated with each other and cooperating at least in an operating position.

13. Circular knitting machine according to claim 12, wherein said end portion (30*a*) is provided at its circumference with at least one recess (53) and said holder (23) is provided with a locking element (52) pre-tensioned by a spring (51), which locking element lies in said recess (53) in said operating position of the thread guide (19).

14. Circular knitting machine according to claim 13, wherein recess (53) is limited by at least one guide surface (53*a*) which is formed in such a way that, when said thread guide (19) is in said operating position, said spring (51) holds said sliding element (49) in said guiding groove (47) at least within a preselected axial adjustment range of said dial arrangement (9).

15. Circular knitting machine according to claim 7, wherein said lever mechanism (24) and said holder (23) are provided with stroke-limiting means (54, 55) which limit said pivoting movement.

16. Circular knitting machine according to one of claims 8, 9 or 10, wherein said second lever (33) is connected to a slider (38), and said slider (38) is connected to said thread guide element (25), said slider (38) being mounted on said second lever (33) and said thread guide element (24) being mounted on said slider (38) so as to be displaceable in directions which differ from one another and being capable of being fixed in a preselected position by fastening screws (40, 43) to fix said thread guide element (25) in position.

17. Circular knitting machine according to one of claims 2, 3 or 4, wherein said guiding part (46) protrudes radially outwards from said dial cam segment (11).

18. Circular knitting machine according to claim 3 or 4, wherein said guiding groove (47) extends along a circular path which is coaxial with said axis of rotation (7).

* * * * *